US007462240B2

(12) United States Patent
Harris et al.

(10) Patent No.: US 7,462,240 B2
(45) Date of Patent: Dec. 9, 2008

(54) MODULE, NOZZLE AND METHOD FOR DISPENSING CONTROLLED PATTERNS OF LIQUID MATERIAL

(75) Inventors: Michael W. Harris, Cumming, GA (US); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 807 days.

(21) Appl. No.: 10/762,076

(22) Filed: Jan. 21, 2004

(65) Prior Publication Data

US 2004/0164180 A1 Aug. 26, 2004

Related U.S. Application Data

(60) Provisional application No. 60/442,434, filed on Jan. 24, 2003.

(51) Int. Cl.

| | |
|---|---|
| ***B05C 11/00*** | (2006.01) |
| ***B05C 5/00*** | (2006.01) |
| ***B05C 3/12*** | (2006.01) |
| ***A47L 5/00*** | (2006.01) |

(52) U.S. Cl. ..... 118/72; 118/325; 118/420; 15/309.1

(58) Field of Classification Search ..... 15/302, 15/309.1; 239/294, 298, 296, 105, 106; 118/420, 325, 72, 62, 302, 500

See application file for complete search history.

(56) References Cited

U.S. PATENT DOCUMENTS

| | | | | |
|---|---|---|---|---|
| 3,997,308 | A | 12/1976 | Drummond et al. | |
| 4,048,861 | A | 9/1977 | Woidke et al. | |
| 4,077,084 | A * | 3/1978 | Benson et al. | 15/309.1 |
| 4,222,758 | A | 9/1980 | Stotler et al. | |
| 4,785,996 | A | 11/1988 | Ziecker et al. | 239/298 |
| 4,801,051 | A | 1/1989 | Lewis et al. | |
| 4,969,602 | A | 11/1990 | Scholl | 239/298 |
| RE33,481 | E | 12/1990 | Ziecker et al. | 239/298 |
| 4,983,109 | A | 1/1991 | Miller et al. | 425/7 |
| 5,102,484 | A * | 4/1992 | Allen et al. | 156/244.11 |
| 5,277,344 | A | 1/1994 | Jenkins | |
| 5,458,291 | A | 10/1995 | Brusko et al. | 239/423 |
| 5,540,774 | A | 7/1996 | Smitherman | |
| 5,620,139 | A | 4/1997 | Ziecker | 239/124 |

(Continued)

FOREIGN PATENT DOCUMENTS

EP 1176232 A1 1/2002

(Continued)

OTHER PUBLICATIONS

ITW DYNATEC(TM), Integra Elastic Strand Coating System, website, 3 pgs., undated.

*Primary Examiner*—Brenda A. Lamb
(74) *Attorney, Agent, or Firm*—Wood, Herron & Evans LLP

(57) ABSTRACT

A liquid dispensing module and nozzle or die tip for dispensing at least one liquid filament from a liquid discharge passage onto at least one moving strand. A strand guide is used for guiding each strand past the nozzle and/or locating each strand relative to the discharged liquid filament. The nozzle includes a process air outlet that supplies a stream of process air impinging each moving strand before the liquid filament is dispensed onto the strand.

8 Claims, 9 Drawing Sheets

U.S. PATENT DOCUMENTS

| | | | | |
|---|---|---|---|---|
| 5,902,540 | A | 5/1999 | Kwok | 264/555 |
| 5,904,298 | A | 5/1999 | Kwok et al. | 239/135 |
| 6,067,928 | A | 5/2000 | Holzer, Jr. et al. | |
| 6,077,375 | A | 6/2000 | Kwok | |
| 6,197,406 | B1 | 3/2001 | Kwok | 428/195 |
| 6,200,635 | B1 | 3/2001 | Kwok | 427/286 |
| 6,461,430 | B1 | 10/2002 | Kwok | 118/325 |
| 6,619,566 | B2 | 9/2003 | Gressett, Jr. et al. | 239/296 |
| 6,911,232 | B2 | 6/2005 | Crane et al. | |
| 2001/0022155 | A1* | 9/2001 | Nakamura | 118/71 |
| 2002/0083895 | A1* | 7/2002 | Nakamura et al. | 118/325 |
| 2002/0088392 | A1* | 7/2002 | Bolyard, Jr. | 118/230 |
| 2002/0104608 | A1* | 8/2002 | Welch et al. | 156/176 |
| 2002/0134858 | A1 | 9/2002 | Gressett, Jr. et al. | |
| 2002/0136833 | A1 | 9/2002 | Riney | |

FOREIGN PATENT DOCUMENTS

| | | | |
|---|---|---|---|
| WO | 9954057 | A1 | 10/1999 |

* cited by examiner

MODULE, NOZZLE AND METHOD FOR DISPENSING CONTROLLED PATTERNS OF LIQUID MATERIAL

CROSS REFERENCE TO RELATED APPLICATIONS

This application claims the benefit of U.S. Provisional Application No. 60/442,434, filed Jan. 24, 2003, the disclosure of which is hereby incorporated by reference herein in its entirety.

FIELD OF THE INVENTION

The present invention generally relates to a liquid material dispensing apparatus and nozzle and, more specifically, to an apparatus and nozzle for dispensing controlled patterns of liquid adhesive strands or filaments.

BACKGROUND OF THE INVENTION

Many reasons exist for dispensing liquid adhesives, such as hot melt adhesives, in the form of a thin filament or strand with a controlled pattern. Conventional patterns used in the past have been patterns involving a swirling effect of the filament by impinging the filament with a plurality of jets of air. This is generally known as controlled fiberization (CF) in the hot melt adhesive dispensing industry. Controlled fiberization techniques are especially useful for accurately covering a wider region of a substrate with adhesive dispensed as single filaments or as multiple side-by-side filaments from nozzle passages having small diameters, such as on the order of 0.010 inch to 0.060 inch. The width of the adhesive pattern placed on the substrate can be widened to many times the width of the adhesive filament itself.

Controlled fiberization techniques are often used to provide better control over adhesive placement. This is especially useful along the edges of a substrate and on very narrow substrates, for example, such as on strands of material (e.g., LYCRA®) used in the leg bands of diapers. Other adhesive filament dispensing techniques and apparatus have been used for producing an oscillating pattern of adhesive on a substrate or, in other words, a stitching pattern in which the adhesive moves back-and-forth generally in a zig-zag form on the substrate. Typically, these dispensers or applicators have a series of liquid and air orifices arranged on the same plane.

Conventional swirl nozzles or die tips typically have a central adhesive discharge passage surrounded by a plurality of air passages. The adhesive discharge passage is centrally located on a protrusion that is symmetrical in a full circle or radially about the adhesive discharge passage. A common configuration for the protrusion is conical or frustoconical with the adhesive discharge passage exiting at the apex. The air passages are typically disposed at the base of the protrusion. The air passages are arranged in a radially symmetric pattern about the central adhesive discharge passage, as in the protrusion itself. The air passages are directed in a generally tangential manner relative to the adhesive discharge passage and are all angled in a clockwise or counterclockwise direction around the central adhesive discharge passage.

Conventional meltblown adhesive dispensing apparatus typically comprise a die tip having multiple adhesive or liquid discharge passages disposed along an apex of a wedge-shaped member and air passages of any shape disposed along the base of the wedge-shaped member. The wedge-shaped member is not a radially symmetric element. Rather, it is typically elongated in length relative to width. The air is directed from the air discharge passages generally along the side surfaces of the wedge-shaped member toward the apex, and the air impacts the adhesive or other liquid material as it discharges from the liquid discharge passages to draw down and attenuate the filaments. The filaments are discharged in a generally random manner.

Various types of nozzles or die tips, such as those of the type described above, have been used to dispense adhesive filaments onto one or more elastic strands. Each strand is typically aligned and directed by a guide proximate the corresponding adhesive discharge passage. The strands tend to acquire airborne particulates present in the environment surrounding the liquid adhesive dispensing apparatus. These airborne particulates consist of dust and other contaminants that primarily originate from the processing operations performed by the production line. In addition, the strands may be intentionally coated with particulates, such as talc, to facilitate movement through the guide.

As each strand interacts with the corresponding guide, the particulates, regardless of origin, may be wiped off and accumulate or agglomerate into larger masses. The agglomerated masses of particulates may dislodge from the guide and incorporate into the dispensed adhesive filament. For example, the agglomerated mass may be dislodged by a knot is formed between the trailing end of a first length of strand material and the leading edge of a second length of strand material joined to provide a continuous strand. Alternatively, the agglomerated mass may remain resident in the guide and increase in dimensions to such an extent that the strand itself is displaced or removed from the guide. In multi-strand dispensing operations, an adjacent guide may capture the displaced strand, which disrupts the application of adhesive to the strands and ultimately produces defective product because the strands are adhesively bonded to a substrate with improper positioning. The reduction in product quality may be significant and may increase the manufacturing cost.

Another difficulty associated with dispensing adhesive onto a guided, moving strand occurs during periods in which the production line is idled, such as for line maintenance. The strand or strands may be fixed in position and in contact with heated surfaces of the adhesive nozzle or die tip. Heat transferred from the nozzle or die tip to each strand may result in strand breakage because of temperature effects. As a result, the downtime of the production line may be increased for reconnection of the strand break or substitution of an unbroken strand.

Yet another difficulty associated with dispensing adhesive onto a guided, moving strand arises from contact between the strand and the adhesive nozzle or die tip. Specifically, the strand wears the metal surfaces of the nozzle or die tip and the metal surfaces of the guide or guides due to frictional wear. Eventually, the wear may necessitate replacement of the nozzle, die tip or guide. Moreover, the contact between the strand and these metal surfaces causes drag on the strand, which may reduce the predictability of adhesive application or may result in broken strands.

What is needed, therefore, is a liquid dispensing module for dispensing a liquid filament onto a substrate in which the difficulties associated with strand guiding are reduced or eliminated.

SUMMARY OF THE INVENTION

The invention is directed to an adhesive applicator and a nozzle for an adhesive applicator in which particulates residing on a strand are removed so that those particulates are less likely to accumulate on surfaces associated with the nozzle.

Such surfaces include, but are not limited to, the guide or guides steering a moving strand for accurate placement of an adhesive filament dispensed from a liquid discharge outlet in the nozzle. Moreover, an adhesive applicator and nozzle according to the principles of the invention may reduce or eliminate the contact between the strand and the guide or guides steering the strand. As a result, the aforementioned difficulties associated with strand guiding are reduced or eliminated.

A nozzle of the invention includes a nozzle body having a liquid supply port, a liquid discharge passage connected in fluid communication with the liquid supply port, and a process air supply port. The nozzle incorporates a mounting surface configured for mounting the nozzle body to a valve module. The nozzle further includes a process air outlet formed in the nozzle body, which is coupled in fluid communication with the process air supply port. The process air outlet is oriented to discharge an air stream impinging the strand before the liquid filament is dispensed from the liquid discharge passage onto the strand.

In accordance with the principles of the invention, a method is provided for dispensing a liquid filament onto a strand from a liquid dispensing nozzle having a liquid discharge passage. The method comprises moving the strand relative to the nozzle and dispensing the liquid filament from the liquid discharge passage onto the strand. The strand is impinged with process air upstream of the liquid discharge passage before the liquid filament is dispensed onto the strand.

The principles of the invention are applicable to dispensing modules and adhesive applicators having one or more sets of liquid discharge passages. Each set of liquid discharge passages dispenses a liquid filament that is applied to one or more multiple moving strands. The strands are subsequently applied in a pattern to a substrate. Therefore, it is desirable to provide a nozzle having multiple guides each of which is associated with a liquid discharge passage and each of which steers one of the multiple moving strands to promote accurate placement of the liquid filament. For each strand, the principles of the invention may be applied for removing particulates from the strand.

These and other features, objects and advantages of the invention will become more readily apparent to those of ordinary skill in the art upon review of the following detailed description, taken in conjunction with the accompanying drawings.

DETAILED DESCRIPTION OF PREFERRED EMBODIMENTS

For purposes of this description, words of direction such as "upward", "vertical", "horizontal", "right", "left" and the like are applied in conjunction with the drawings for purposes of clarity and providing a reference frame in the present description only. As is well known, liquid dispensing devices may be oriented in substantially any orientation, so these directional words should not be used to imply any particular absolute directions for an apparatus consistent with the invention.

Figure 1:
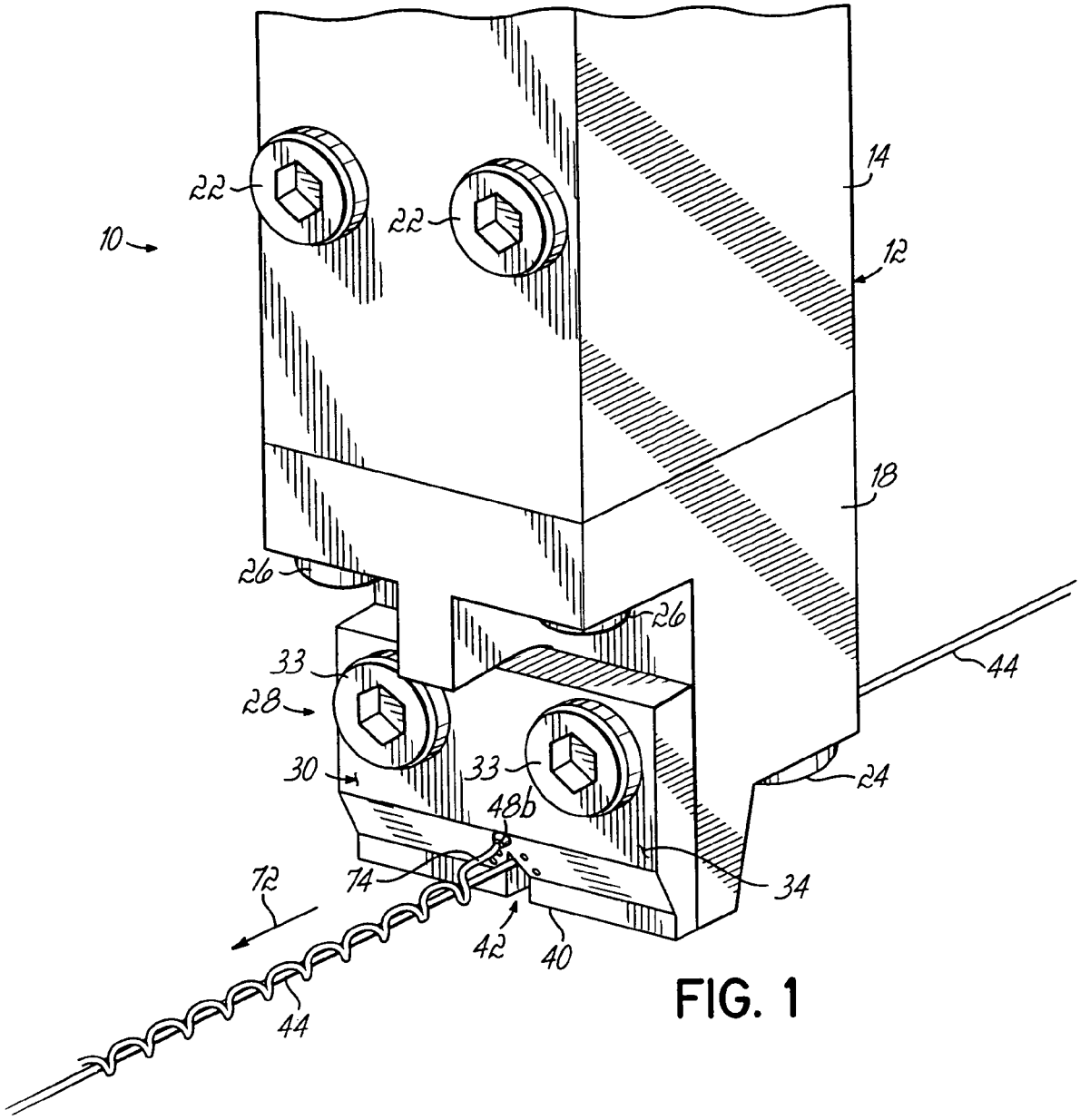
FIG. 1 is a perspective view of a dispensing module including one nozzle or die tip constructed in accordance with a preferred embodiment of the invention.
Figure 2:
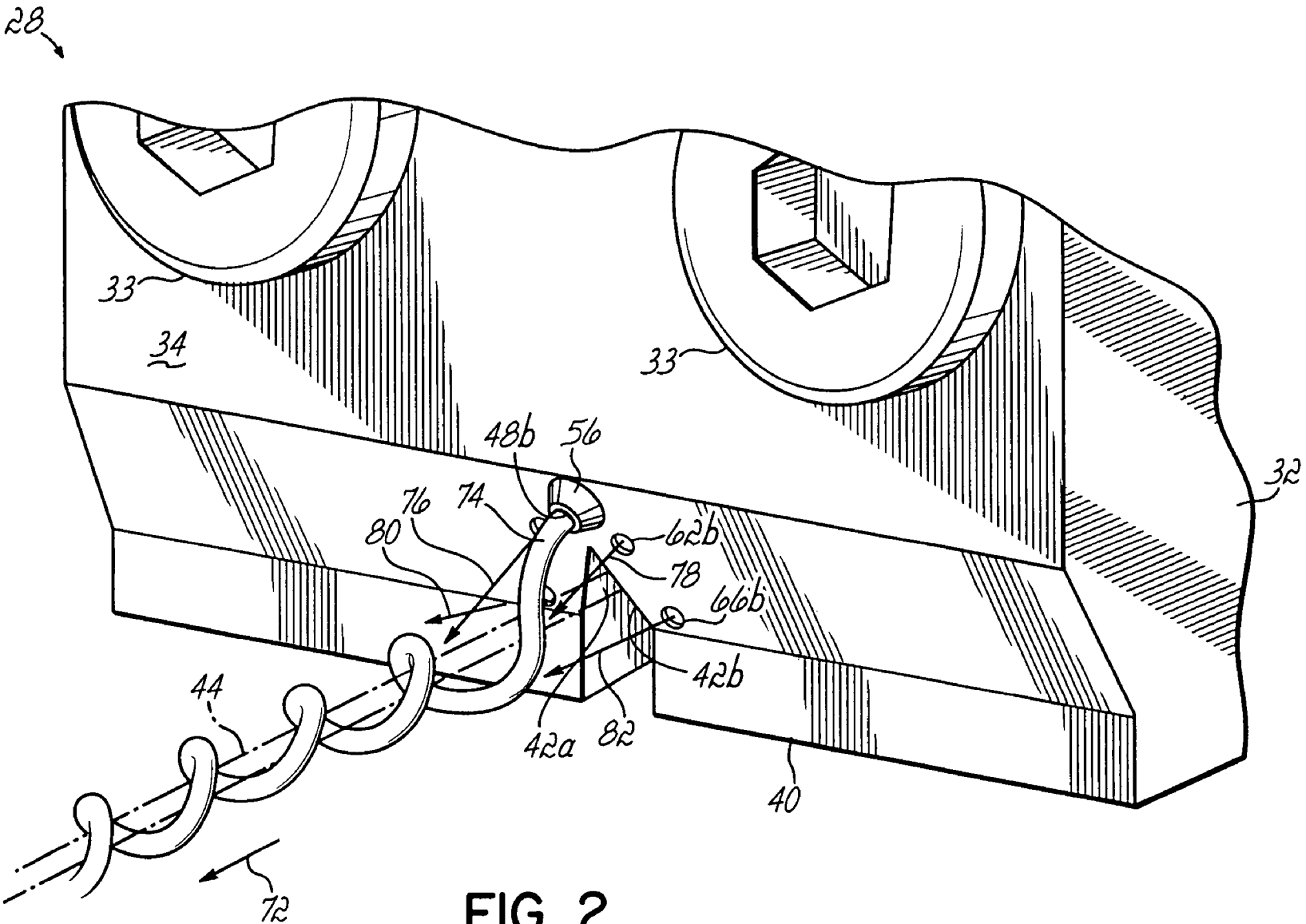
FIG. 2 is an enlarged perspective view of the nozzle or die tip of FIG. 1.

Referring first to FIGS. 1 and 2, an exemplary dispensing module 10 of the present invention is shown. Dispensing module 10 generally comprises a module body 12 including a central body portion 14 and a lower body portion 18. An upper cap (not shown) is secured to central body portion 14 by fasteners (not shown). Central body portion 14 includes fasteners 22 for securing module 10 to a suitable support, such as a manifold (not shown) which supplies liquid, such as hot melt adhesive, to module 10. Lower body portion 18 is secured to central body portion 14 by respective pairs of fasteners 24, 26. A nozzle assembly or die tip assembly 28 receives liquid and pressurized air from respective supply passages. Nozzle assembly 28 is secured to lower body portion 18 and includes a nozzle or die tip 30. Fasteners 33 secure nozzle 30 to lower body portion 18. Module or applicator 10 is preferably of the on/off type and includes internal valve structure for selectively dispensing liquid, such as hot melt adhesive or other viscous liquid typically formed from polymeric material, in the form of one or more filaments. A suitable module structure usable in connection with nozzle 30 is part no. 309637 available from Nordson Corporation, Westlake, Ohio, which is the assignee of the present invention.

Referring first to FIGS. 2-8, a nozzle 30 is shown constructed in accordance with the preferred embodiment. Nozzle 30 includes a body 32 preferably formed from a metal such as brass and having a front surface 34, a rear surface 36, an upper surface 38 and a lower surface 40. A V-shaped notch 42 is formed in lower surface 40 and is generally defined by a pair of converging opposite sidewalls 42*a*, 42*b*. Notch 42 serves as a guide to direct an infed strand 44 of substrate material past air and liquid outlets of nozzle body 32. Rear surface 36 is adapted to be secured against the face of a dispenser and receives liquid material, such as hot melt adhesive, through a liquid inlet port 46 extending into body 32. Liquid inlet port 46 further communicates with a liquid discharge passage 48 having a longitudinal axis 48*a* extending in a plane which includes a centerline 43 of notch 42. In the exemplary embodiment shown, axis 48*a* forms an angle of 37° to lower surface 40. The liquid discharge passage 48 thus forms an acute angle with rear surface 36. In another exemplary embodiment, the angle between the liquid discharge passage and the rear surface 36 is approximately 60° to 80°. An outlet 48*b* of liquid discharge passage 48 is located in a semi-circular recess 54 formed into front surface 34 proximate the apex of notch 42. The liquid discharge outlet 48*b* is at the apex of a frustoconical protrusion 56 that extends from semi-circular recess 54 in a direction along axis 48*a*. Air inlet recesses 50, 52 are formed into rear surface 36 and communicate with four air discharge passages 60, 62, 64, 66 extending along respective axes 60*a*, 62*a*, 64*a*, 66*a*.

Figure 3:
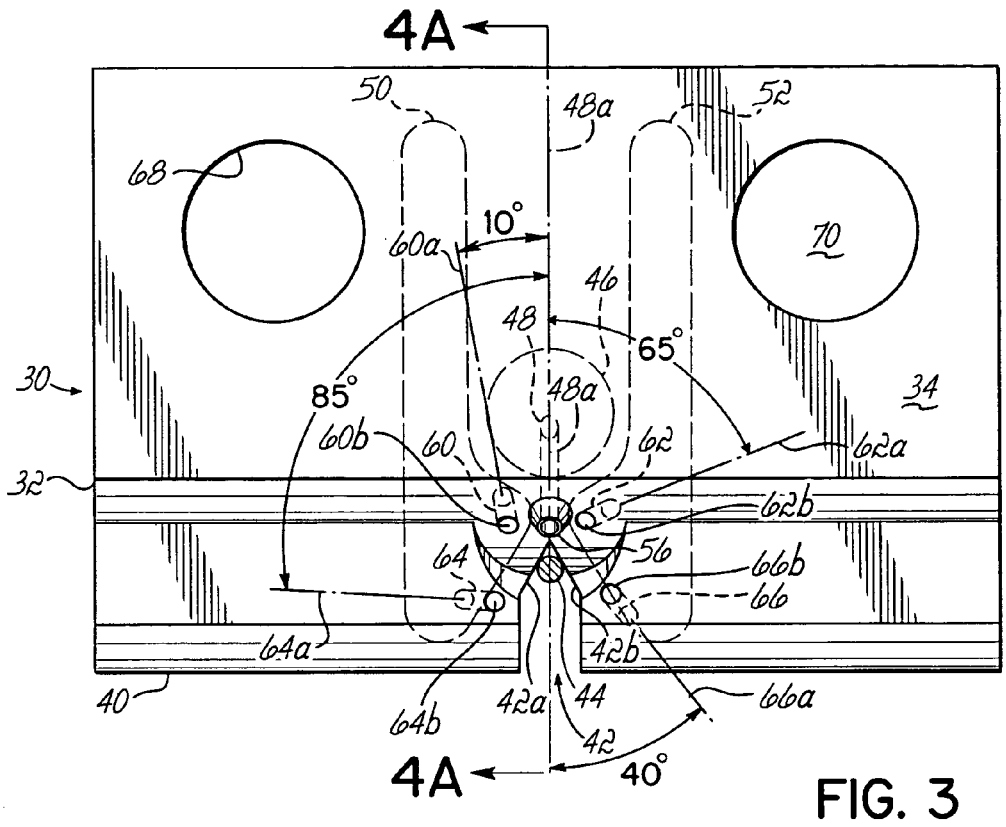
FIG. 3 is a front elevational view showing the discharge portion of the nozzle or die tip.
Figure 4A:
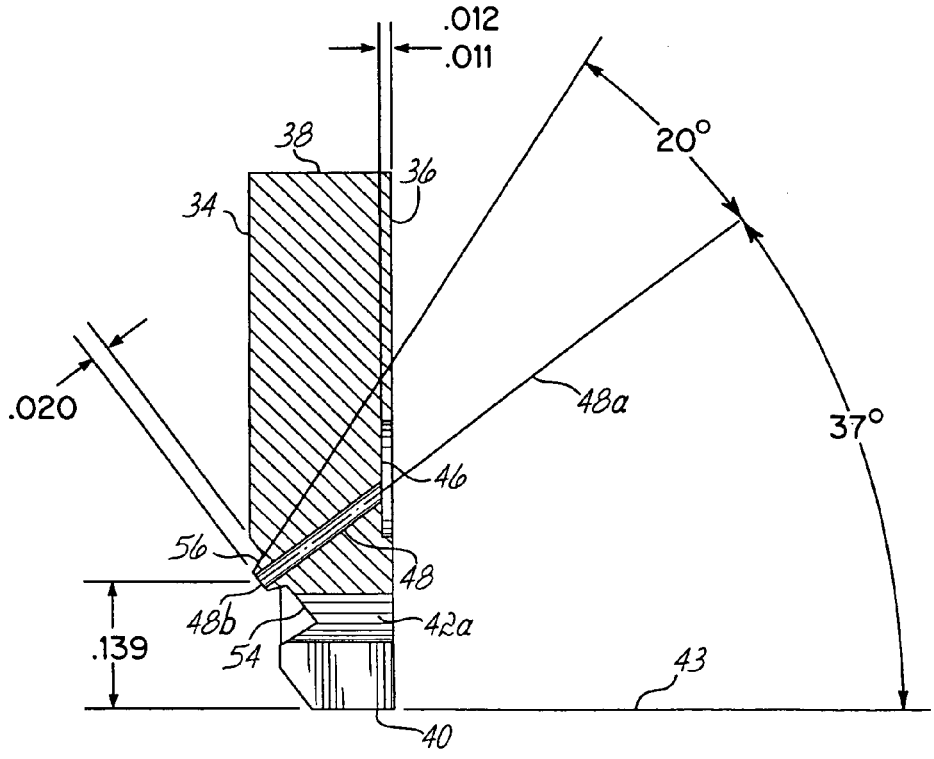
FIG. 4A is a cross-sectional view of the nozzle or die tip taken along line 4A-4A of FIG. 3.
Figure 4:
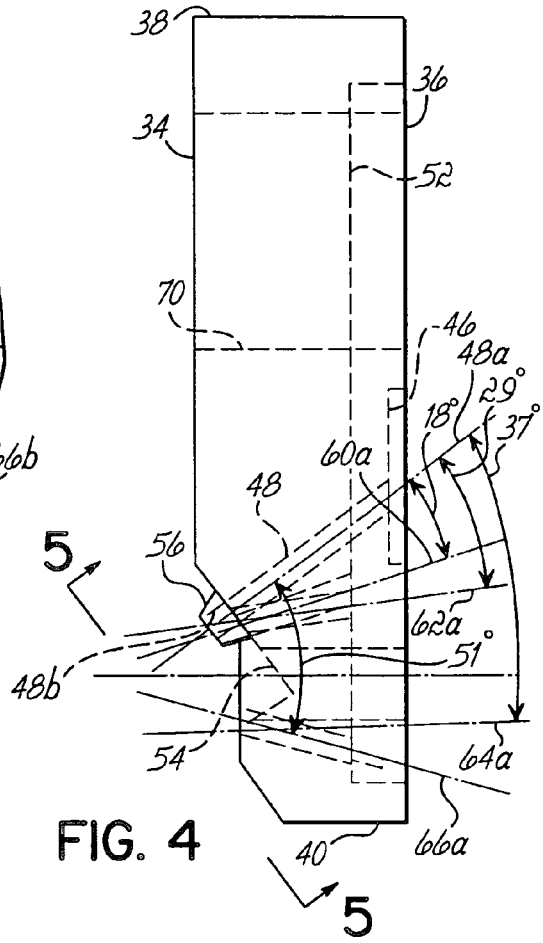
FIG. 4 is a side elevational view of the nozzle or die tip.
Figure 6:
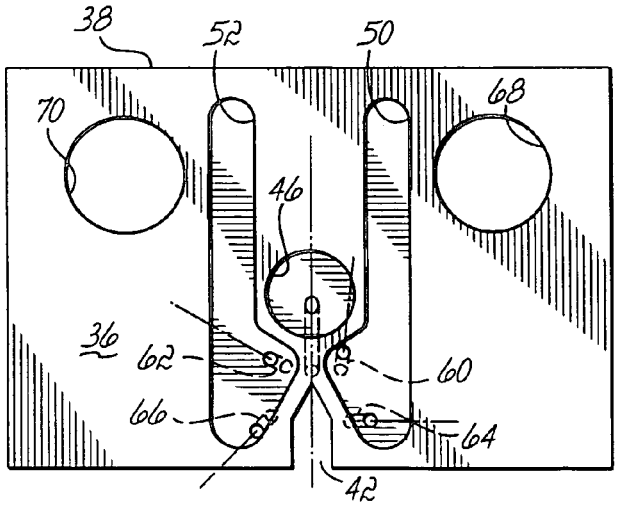
FIG. 6 is a rear elevational view of the nozzle or die tip.
Figure 7:
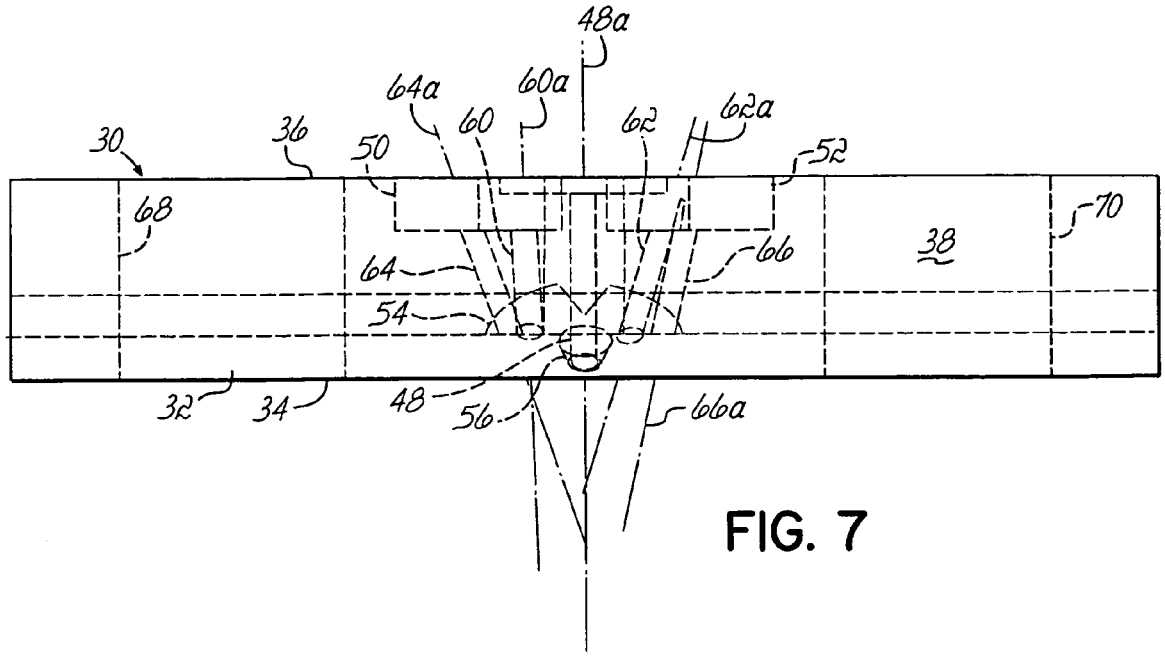
FIG. 7 is a top view of the nozzle or die tip.

Air discharge passages 60, 62, 64, 66 exit at outlets 60*b*, 62*b*, 64*b*, 66*b* on front surface 34 and on semi-circular recess 54, adjacent liquid discharge outlet 48*b* best shown in FIGS. 3 and 4. Air discharge passages 60, 62, 64, 66 discharge pressurized air generally toward axis 48*a* of liquid discharge passage 48, with compound angles best comprehended by reviewing both FIGS. 3-5. Holes 68, 70 extend through body 32 for receiving fasteners 33 (FIG. 1) used to secure nozzle 30 to a dispenser.

As viewed from the front surface 34 of nozzle body 32 (FIG. 3), axes 60*a*, 64*a* of air discharge passages 60, 64 are disposed at approximately 10° and 85°, respectively, from the axis 48*a* of liquid discharge passage 48. Axes 62*a*, 66*a* of passages 62, 66 are disposed at approximately 65° and 40° from axis 48*a*, as measured from lower surface 40. As viewed from the side of nozzle body 32, the axes 60*a*, 62*a*, 64*a*, 66*a* of air discharge passages 60, 62, 64, 66 form angles of approximately 18°, 29°, 37°, and 51° with axis 48*a* of liquid discharge passage 48 as best depicted in FIG. 4.

The four discharge outlets 60*b*, 62*b*, 64*b*, 66*b* have centers which are positioned along a common radius from a point corresponding to the location of a substrate received into notch 42. In an exemplary embodiment, the centers of air discharge outlets 60*b*, 62*b*, 64*b*, and 66*b* are positioned along a radius located from a point which is 0.027-inch from the apex of notch 42 when notch 42 has converging side walls 42*a* and 42*b* separated by an angle of 60°. This corresponds to a strand 44 having a cross sectional diameter of 0.031 inch.

Figure 5:
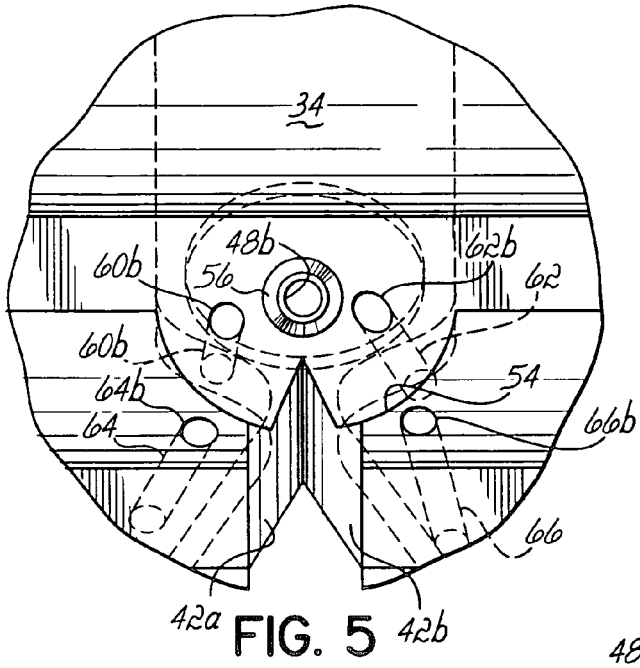
FIG. 5 is an enlarged view of the nozzle discharge portion shown in FIG. 3.

The four discharge outlets 60*b*, 62*b*, 64*b*, 66*b* are arranged to form a generally square pattern below the liquid discharge outlet 48*b* when viewed along axis 48*a*, as depicted in FIG. 5. Pressurized air from air discharge outlets 60*b*, 62*b*, 64*b*, 66*b* is directed in directions generally tangential to the liquid filament discharging from passage 48, as opposed to directly impacting the filament discharging from passage 48. The size of the swirl pattern produced by pressurized air from air discharge outlets 60*b*, 62*b*, 64*b*, 66*b* impinging upon liquid filament as it exits liquid discharge outlet 48*b* may be adjusted by varying the angular orientation of air discharge passages 60, 62, 64, 66.

FIGS. 1 and 2 illustrate operation of an exemplary nozzle of the present invention and a swirl pattern which is produced by the exemplary nozzle. A substrate in the form of a strand 44 is received into notch 42 and moves in a direction indicated by the arrow 72. As the strand 44 passes beneath liquid discharge outlet 48*b*, a liquid filament 74 is dispensed from the outlet 48*b* generally also in the direction of arrow 72, but with a downward angle as well, and deposited on the strand 44. Jets of pressurized air from air discharge outlets 60*b*, 62*b*, 64*b*, and 66*b* are directed generally tangentially toward the liquid filament 74, as depicted by arrows 76, 78, 80, 82 in FIG. 2. The jets of pressurized air cause the liquid filament 74 to move in a swirling motion as it is deposited on the strand 44. After the filament 74 has been deposited on the strand 44, portions of the liquid filament 74 may be drawn by gravity and/or centrifugal forces to wrap around the substrate 44. The size of the swirl patterns may be varied by varying the number and arrangement of the air jets (i.e., discharge outlets).

Figure 8:
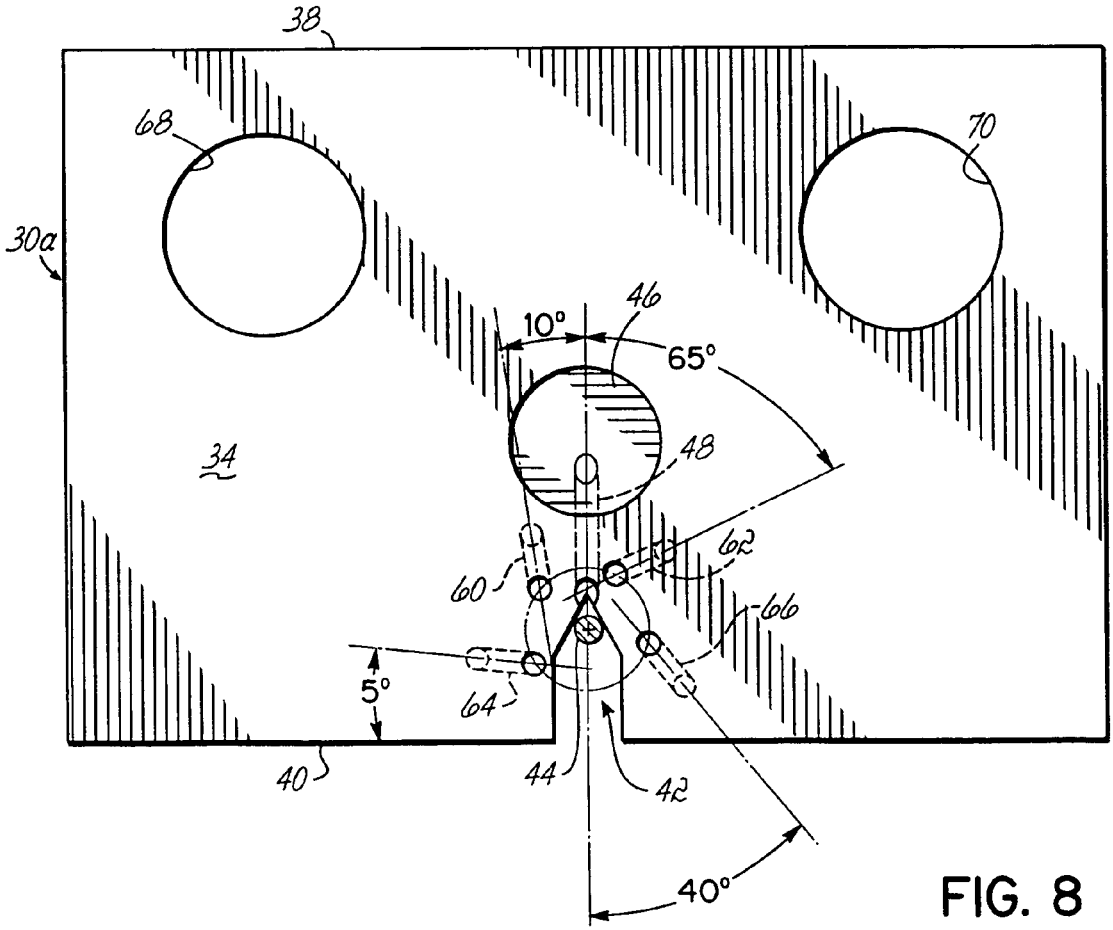
FIG. 8 is a front elevation view of an alternative nozzle or die tip in accordance with the invention.

FIG. 8 illustrates one of many possible alternative configurations for a nozzle or die tip 30'. In this regard, the front face of nozzle 30' is a flat surface and is not beveled or inset to angle the various passages downwardly as in the first embodiment. All other reference numbers are identical as between FIGS. 1-7 and FIG. 8 and the description thereof may be referred to above for an understanding of this embodiment as well.

Figure 9:
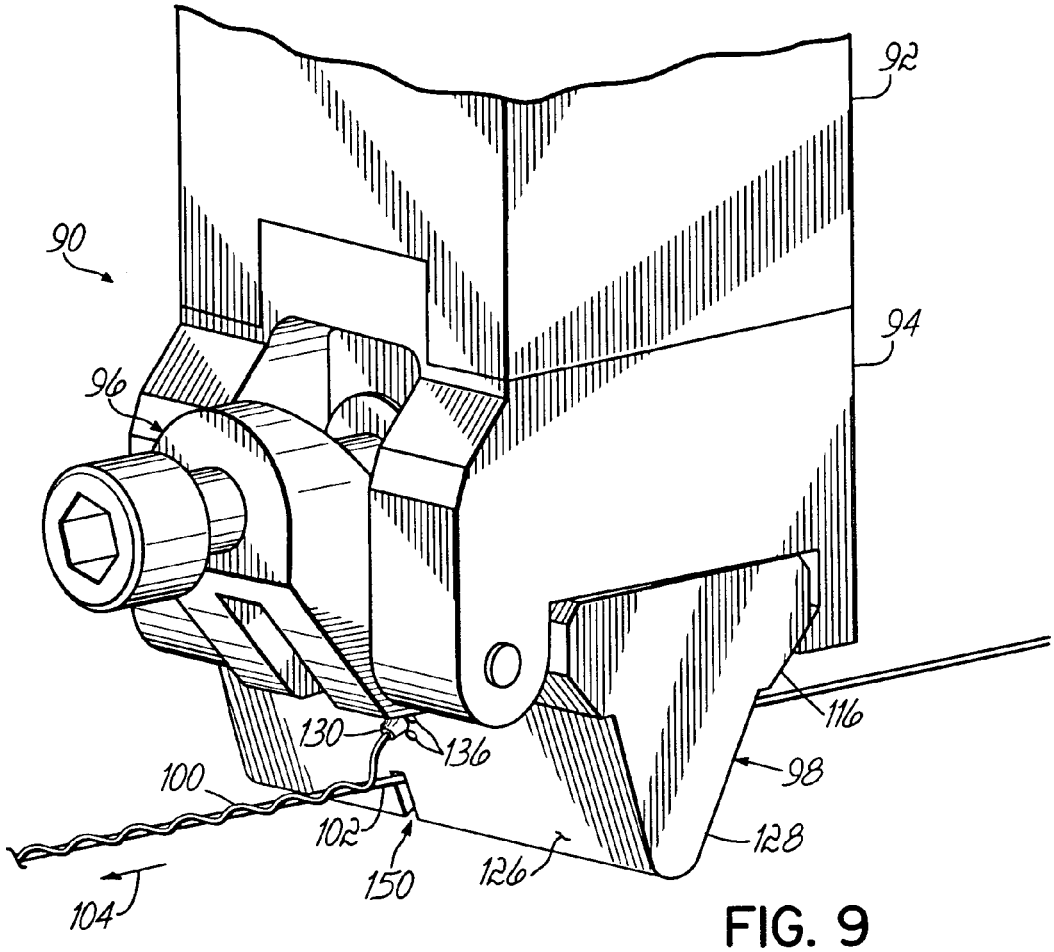
FIG. 9 is a perspective view of another exemplary dispensing module and nozzle of the present invention.

Referring to FIGS. 9-14, there is shown another exemplary dispensing module 90 and nozzle 98 according to the present invention. The dispensing module 90 depicted in FIG. 9 is similar to the exemplary dispensing module 10 of FIG. 1, having a central body portion 92 and a lower body portion 94, but further including a quick disconnect mechanism 96 for facilitating the installation and removal of various nozzles or dies from the dispensing module 90, as more fully described in U.S. Pat. No. 6,619,566, filed on Mar. 22, 2001 and assigned to the assignee of the present invention. FIG. 9 further illustrates another exemplary nozzle 98 coupled to the dispensing module 90 and secured with the quick disconnect mechanism 96. Nozzle 98 receives liquid and pressurized air from the dispensing module 90 and dispenses a filament of liquid material 100 in a controlled pattern to a strand of substrate material 102 moving relative to the die 98, generally in the direction of arrow 104, in a manner similar to that described above with respect to nozzle 30.

Figure 10:
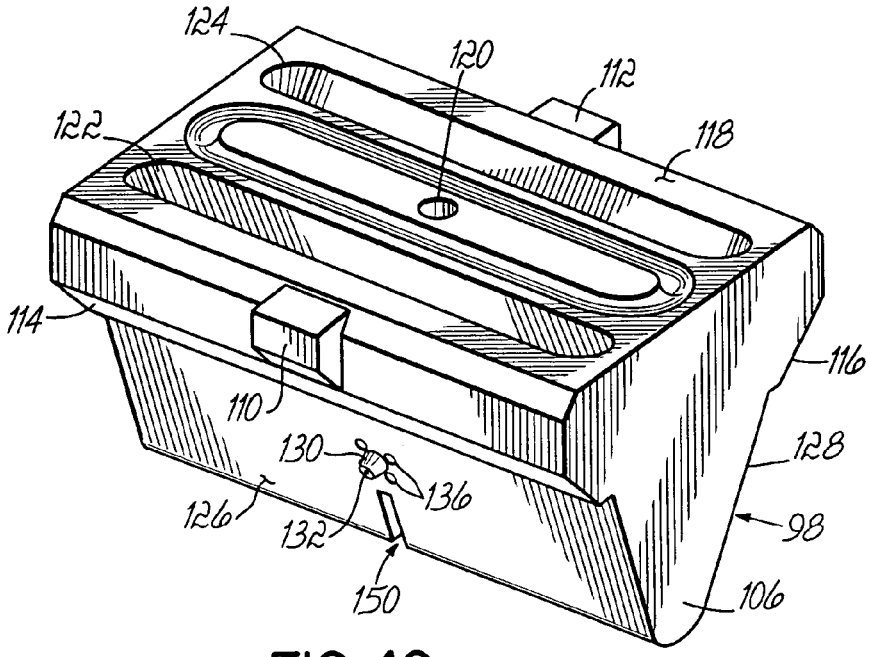
FIG. 10 is a perspective view of the nozzle of FIG. 9.
Figure 11:
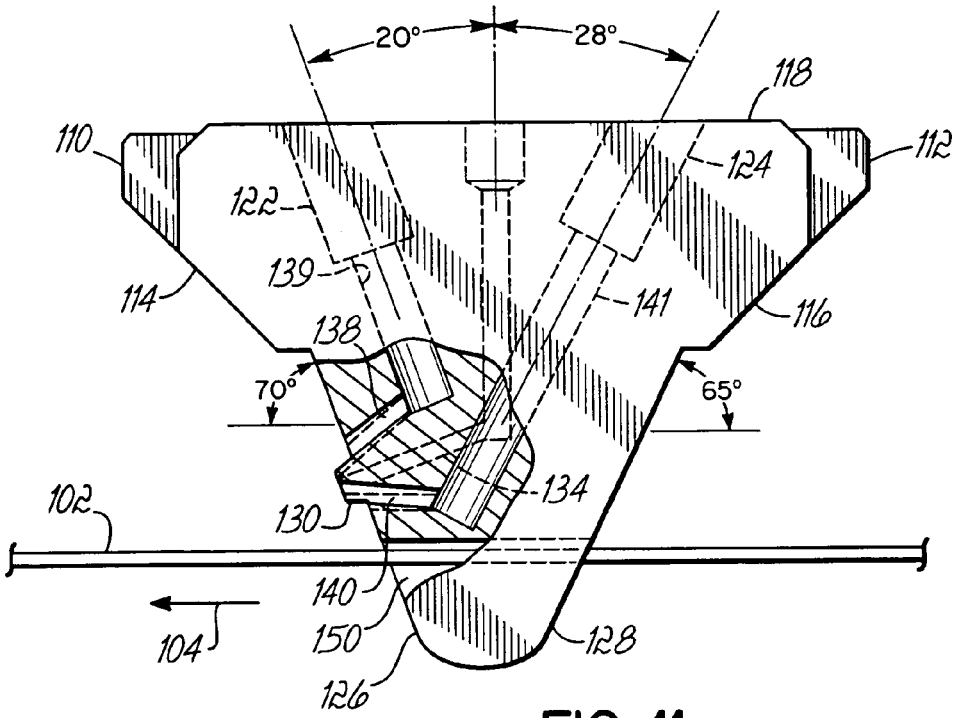
FIG. 11 is a side view of the nozzle of FIG. 10, depicting air and liquid passages of the nozzle.
Figure 12:
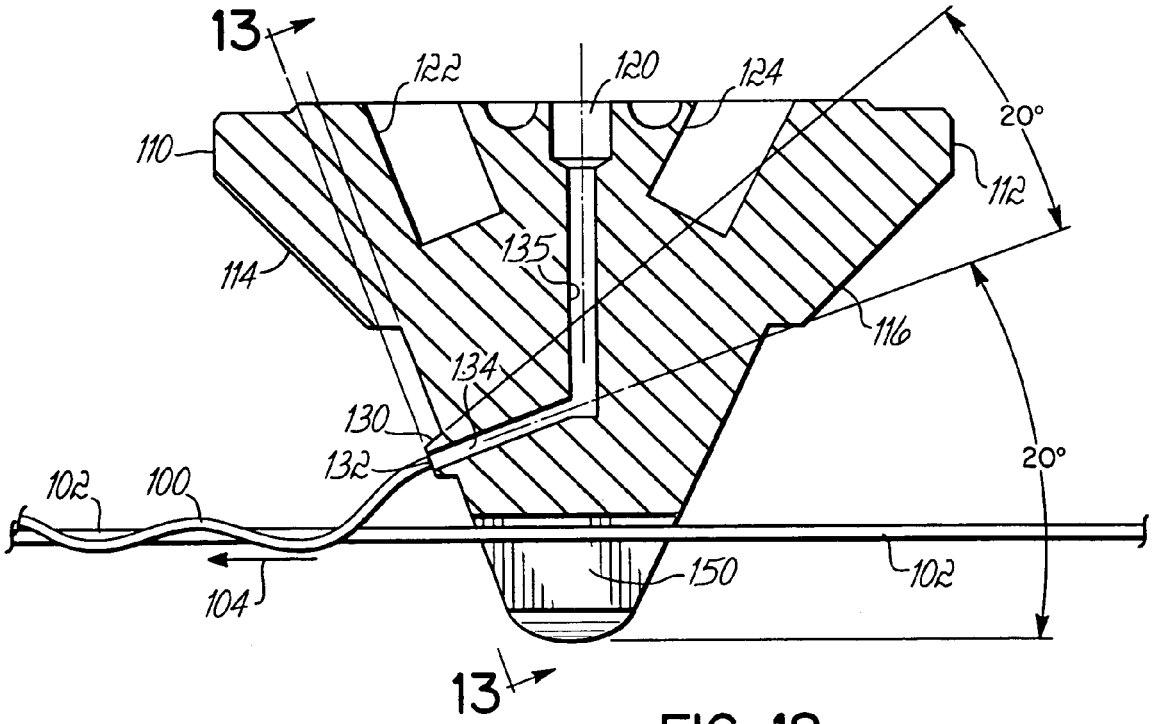
FIG. 12 is a cross-sectional view of the nozzle of FIG. 10, through the center of the nozzle.

Referring now to FIG. 10, the exemplary nozzle 98 is shown in more detail. Nozzle 98 comprises a nozzle body 106 and includes protrusions 110, 112 and angled cam surfaces 114, 116, as more fully described in U.S. Pat. No. 6,619,566, to facilitate coupling the nozzle 98 with the dispensing module 90. The nozzle body 106 includes a first side 118 configured to mount to the lower portion 94 of the dispensing module 90. The first side 118 includes a liquid supply port 120 and first and second process air supply ports 122, 124 which mate to corresponding liquid and air supply passages in the dispensing module 90 in a manner similar to that described above for module 10. As depicted in FIGS. 10-12, the exemplary nozzle body 106 has a generally wedge-shaped cross-section including second and third (i.e., downstream and upstream) sides 126, 128. A frustoconically-shaped protrusion 130 extends from the second side 126 of the nozzle body 106 and includes a liquid discharge outlet 132 disposed on a distal end of the protrusion 130.

The liquid discharge outlet 132 is in fluid communication with a liquid discharge passage 134, which in turn is in communication with the liquid supply port 120 by way of a liquid passage 135, whereby liquid material from the module 90 may be dispensed from the liquid discharge outlet 132 to the strand 102 of substrate material as more clearly depicted in FIGS. 11 and 12. At least a portion of the liquid discharge passage 134 is oriented to form an acute angle with a plane parallel to the first side 118, and thus forms an angle with a direction corresponding to of movement of the strand 102, generally indicated by arrow 104. The liquid discharge passage of the exemplary embodiment is inclined at approximately 20° to the first side, whereby the liquid material is dispensed from the liquid discharge outlet to the strand and generally in the direction of strand movement.

Figure 13:
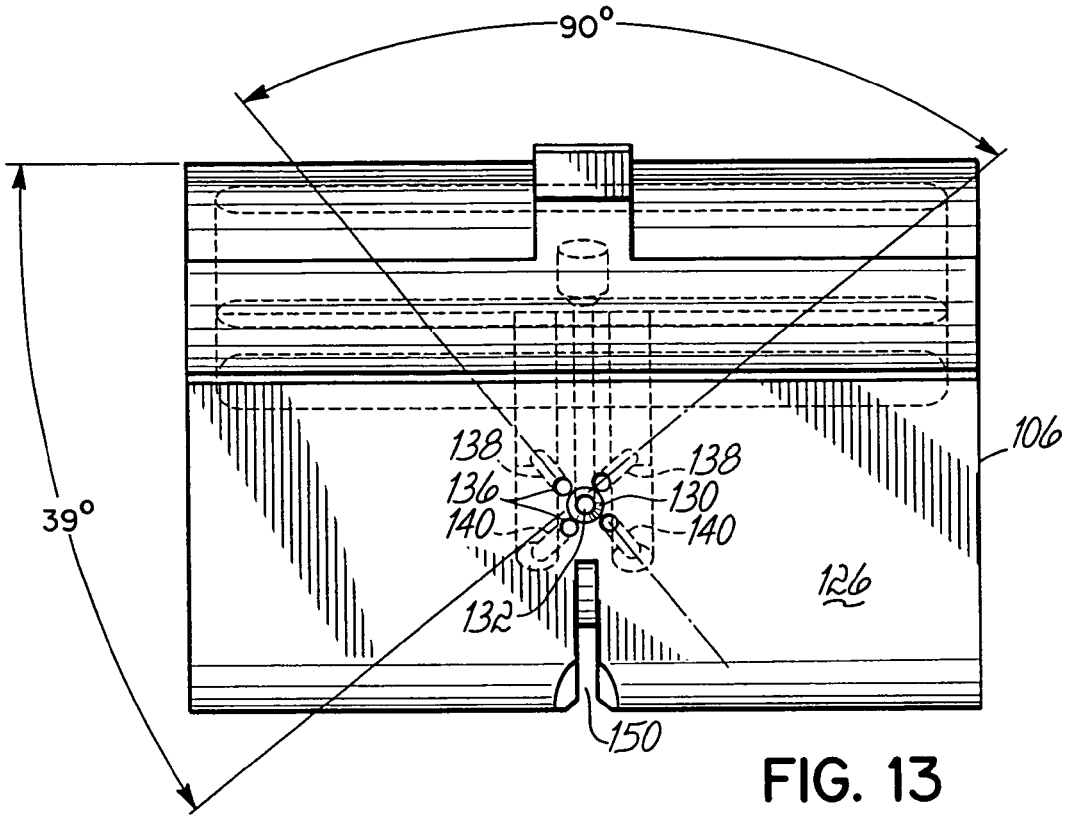
FIG. 13 is a view of the nozzle of FIG. 10, taken along lines 13-13 in FIG. 12.
Figure 14:
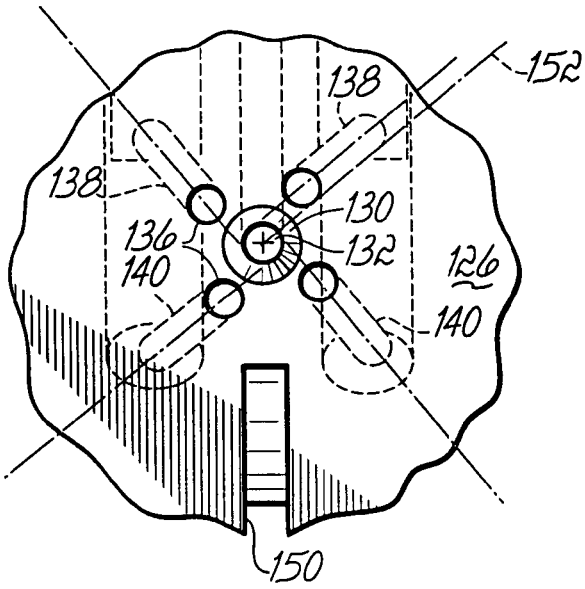
FIG. 14 is a detail view of the air and discharge outlets of FIG. 13.

The second side 126 of the nozzle body 106 further includes a plurality of air discharge outlets 136 proximate the liquid discharge outlet 132 and in fluid communication with air discharge passages 138, 140 by way of respective air passages 139,141 which extend to the air supply ports 122, 124 on the first side 118 of the nozzle body 106. The air discharge passages 138, 140 of the exemplary nozzle body 106 are inclined at approximately 20° and approximately 28° from an axis through liquid passage 135. As shown in FIGS. 13 and 14, the air discharge outlets 136 are arranged generally around the base of the frustoconical protrusion 130 and are configured to direct process air toward the liquid filament 100 dispensed from the liquid discharge outlet 132 in a manner similar to that described above for nozzle 30.

In the exemplary nozzle body 106, four air discharge outlets 136 are disposed in a generally square pattern around the liquid discharge outlet 132 at the base of the frustoconical protrusion 130. Diagonally opposite air discharge passages 138, 140 or, in other words, air discharge passages disposed at opposite corners of the square-shaped pattern, are symmetric and disposed in planes that are at least nearly parallel to each other. The air discharge passages 138, 140 are each offset from axes 152 that are normal to a longitudinal axis of the liquid discharge passage 134, and each forms a true angle of approximately 30° with the longitudinal axis of the liquid discharge passage 134 such that the air stream discharged from each air discharge passage 138 is tangential to the liquid filament 100 discharged from the liquid discharge passage 134, as opposed to directly impacting the filament 100. This arrangement of air and liquid discharge passages provides a liquid filament which is moved in a controlled manner as it is dispensed from the liquid discharge passage to create a desired pattern on the strand 102 of substrate material. Variation of the pattern is possible by adjusting the offset spacing and orientation of the air discharge passages 138, 140 relative to the liquid discharge passage 134, as will be apparent to those skilled in the art.

The nozzle body 106 further includes a notch 150 formed into an end of the nozzle body 106 opposite the first side 118 and proximate the liquid discharge outlet 132 to direct the strand 102 of substrate material past the air and liquid discharge outlets 132, 136 disposed on the second side 126 of the nozzle body 106. As shown more clearly in FIGS. 11 and 12, the notch 150 extends between an upstream entrance on the third side 128 and a downstream exit on the second side 126 of the nozzle body 106. In an exemplary embodiment, the second and third sides 126, 128 are configured to form acute angles with the first side 118. In one exemplary embodiment, the second side 126 forms an angle of approximately 60-80° with the first side 118. In another aspect of the invention, the third side 128 forms an angle no greater than approximately 70° with the first side 118. Advantageously, the angle of the third side 128 facilitates the passage of knots formed in the strand 102 without causing breakage of the strand 102. These knots are typically formed in the infed strand material, for example, when the trailing end of a first length of strand material is secured to the leading end of a second length of strand material from a supply to permit continuous operation of the module 90.

Figure 15:
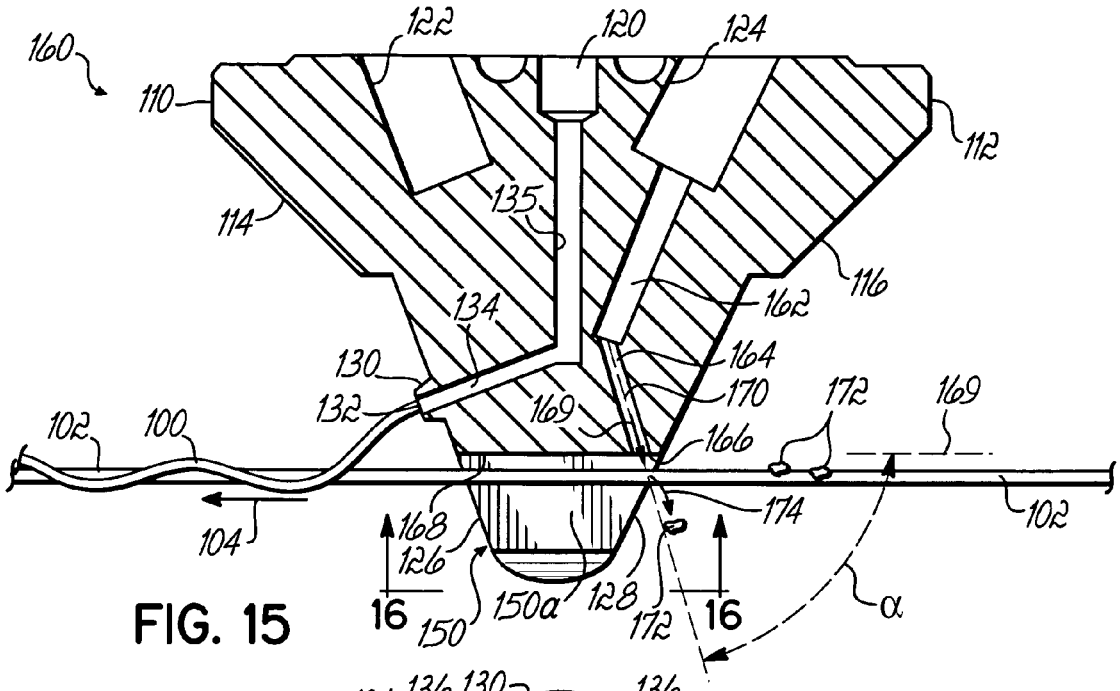
FIG. 15 is a cross-sectional view of an alternative embodiment of a nozzle in accordance with the principles of the invention.
Figure 16:
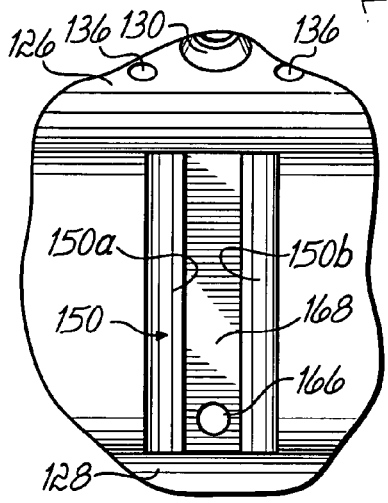
FIG. 16 is a bottom view of the nozzle of FIG. 15 taken generally along line 16-16 of FIG. 15, shown with the liquid filament absent for clarity.

With reference to FIGS. 15 and 16 in which like reference numerals refer to like features in FIGS. 9-14, a nozzle 160 is depicted that is capable of being coupled with a dispensing module, such as dispensing module 90 (FIG. 9). Nozzle 160 receives liquid and pressurized air from the dispensing module 90, when coupled thereto and during operation, and dispenses a filament of liquid material 100 in a controlled pattern to a strand 102 of substrate material moving relative to the nozzle 160, generally in the direction of arrow 104, in a manner similar to that described above with respect to nozzles 30 and 98.

Nozzle 160 includes a supply passageway 162 coupled in fluid communication with the second process air supply port 124, which receives process air from an air supply passage of the dispensing module 90. It is contemplated by the invention that the supply passageway 162 may be coupled in fluid communication with the first process air supply port 122 or with another air supply port (not shown) for supplying process air to the supply passageway 162. Coupled in fluid communication with the supply passageway 162 is a discharge passageway 164 that includes a process air outlet 166 exiting a base or planar surface 168 of notch 150. The air flow discharged from the outlet 166, indicated generally by arrow 169, is directed generally parallel to a longitudinal axis 170 of the discharge passageway 164. The longitudinal axis 170 is inclined relative to the planar surface 168, and relative to the strand 102, and is oriented generally toward the third side 128 of nozzle 160. Typically, the longitudinal axis 170 is inclined in an upstream direction at an acute angle, $\alpha$, of between about 1° and about 89°, typically between about 60° and about 80°, and most typically at about 75° relative to a line 169 aligned parallel to the length of strand 102. As a result, the air flow, or at least a significant component of the air flow, is angled in an upstream direction opposite to the movement direction 104 of strand 102. In contrast, the process air discharged from air discharge outlets 136 is directed downstream generally in the direction of motion 104 and proximate to the liquid discharge outlet 132.

The air flow from outlet 166 impinges the strand 102 proximate to an upstream entrance to the notch 150 and, hence, does not influence the controlled movement of liquid filament 100 dispensed from the liquid discharge outlet 132 that creates a desired pattern on strand 102. Process air from air discharge outlets 136 impinges the liquid filament 100 but, because the air discharge outlets 136 are positioned on the second side 126 of the nozzle 160, the air streams from outlets 136 do not operate for particulate removal. Conversely, the air stream from outlet 166 does not impinge the liquid filament 100 and, therefore, does not participate in creating the desired pattern on the strand 102. In other words, the air stream from outlet 166 and the air streams from outlets 136 operate independently of one another.

Notch 150 includes opposing, spaced-apart sidewalls 150*a* and 150*b* projecting from planar surface 168 that operate as an inverted U-shaped guide having for positioning the strand 102 relative to the liquid discharge outlet 132. The sidewalls 150*a*, 150*b* limit the lateral or transverse range of movement of the strand 102 relative to the liquid discharge outlet 132 so that strand 102 is generally aligned with outlet 132. The planar surface 168 limits the movement of the strand 102 in one vertical direction as strand 102 moves through notch 150, if the strand 102 contacts surface 168.

Particulates 172 are associated with strand 102 before its arrival at nozzle 160 either intentionally or as a contaminant from the surrounding environment. The air flow discharged from outlet 166 has a velocity or magnitude sufficient for overcoming the forces adhering the particulates 172 to the strand 102 and removing particulates 172 from strand 102 either before, as, or after each particulate 172 carried by strand 102 enters notch 150. The orientation of the longitudinal axis 170 and the air flow relative to the planar surface 168 and the strand 102 determines the specific position relative to notch 150 at which each particulate 172 is removed from strand 102. The magnitude of the air flow is determined by the dimensions of supply passageway 162, discharge passageway 164, and the outlet 166, and also by the pressure of the process air in second process air supply port 124. The generally upstream direction of the air flow discharged from outlet 166 propels the particulates 172 removed from strand 102 away from the notch 150 and the strand 102.

The air flow from outlet 166 reduces or eliminates the trapping and accumulation of particulates 172 in notch 150, which reduces or prohibits the presence of agglomerated masses of particulates 172 within notch 150. Because agglomerated masses of particulates 172 are less likely to be formed, their incorporation into the dispensed adhesive filament 100 is less likely. Moreover, strands 102 undergoing multi-strand dispensing are less likely to be displaced from their corresponding notches 150 by strand knots and the like due to the absence of agglomerated particulates 172. Consequently, the product with which the strands 102 are incorporated is less likely to be defective due to improper strand positioning.

The air flow from outlet 166 also reduces the incidence of strand breakage if strand 102 is stationary within notch 150, such as when production line maintenance is performed. The strand 102 is proximate to or in contact with planar surface 168 and sidewalls 150*a* and 150*b* forming the notch 150 (i.e., the strand guide). The air flow from outlet 166 may cool the strand 102 and/or may operate to space the strand 102 from the strand guide so that the strand 102 and strand guide are non-contacting so as to reduce heat transfer from the nozzle 160 to strand 102. For purposes of cooling, the temperature of the process air emitted from outlet 166 may be lower than the temperature of the sidewalls 150*a* and 150*b* and planar surface 168 defining notch 150. The air flow from outlet 166 may also space the strand 102 from planar surface 168 of the strand guide as the strand 102 is moving in movement direction 104. This separation reduces the contact between strand 102 and planar surface 168 so that wear on surface 168 is reduced and, moreover, reduces the frictional drag acting on strand 102.

Figure 17:
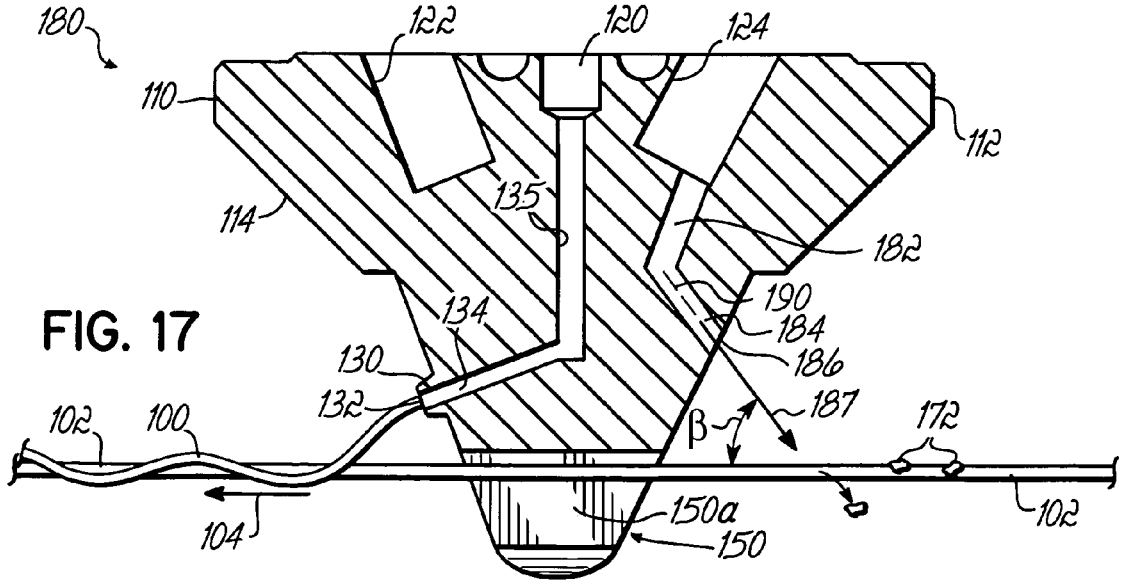
FIG. 17 is a cross-sectional view of an alternative embodiment of a nozzle in accordance with the principles of the invention.

With reference to FIG. 17 in which like reference numerals refer to like features in FIGS. 15 and 16, a nozzle 180 is configured to be coupled with a dispensing module, such as dispensing module 90 (FIG. 9). Nozzle 180 receives liquid and pressurized air from dispensing module 90, when coupled thereto and during operation, and dispenses a filament of liquid material 100 in a controlled pattern to a strand 102 of substrate material moving relative to the nozzle 180, generally in the direction of arrow 104, in a manner similar to that described above with respect to nozzles 30, 98 and 160.

Nozzle 180 includes a supply passageway 182 coupled in fluid communication with second process air supply port 124, which receives process air from an air supply passage of the dispensing module 90. It is contemplated by the invention that the supply passageway 182 may be coupled in fluid communication with the first process air supply port 122 or with any other air supply port (not shown) for supplying process air to the supply passageway 182. A discharge passageway 184 is coupled in fluid communication with the supply passageway 182 and includes an outlet 186 exiting third side 128. Process air is discharged from the outlet 186 generally in a direction of arrow 187, which is directed generally parallel to a longitudinal axis 190 of the discharge passageway 184. Longitudinal axis 190 is inclined relative to the strand 102. Typically, the longitudinal axis 190 is inclined at an angle, β, of between about 20° and about 90°, typically between about 35° and about 55°, and most typically about 45°. As a result, the air flow, or at least a significant component of the air flow, is angled in an upstream direction opposite to the movement direction 104 of strand 102. The air flow impinges the strand 102 proximate to an upstream entrance to the notch 150. The air flow from outlet 186 does not influence the controlled movement of liquid filament 100 dispensed from the liquid discharge outlet 132 that creates a desired pattern on strand 102.

The air flow discharged from outlet 186 has a velocity or magnitude sufficient for overcoming the forces adhering the particulates 172 to the strand 102 and removing particulates 172 from strand 102 before each particulate 172 carried by strand 102 enters notch 150. The magnitude of the air flow is determined by the dimensions of supply passageway 182, discharge passageway 184, and the outlet 186, and also by the pressure of the process air in second process air supply port 124. The generally upstream direction of the air flow discharged from outlet 186 propels the particulates 172 removed from strand 102 in a direction, generally indicated by arrow 194, away from the notch 150 and the strand 102. As a result, particulates 172 are less likely to become trapped and accumulate into an agglomerated mass within notch 150, which provides the benefits described above.

The principles of the invention have been illustrated for guides structured as notch 150. However, the cleaning of particulates 172 from the strand 102 are applicable to other types of guides (not shown), such as undriven rollers, upstream from the dispensing module 90. In these instances, the air flow discharged from the outlet 166 or the outlet 186 impinges either the roller of the strand 102 upstream from the roller. If the rollers are coated with liquid, the particulates 172 could collect and accumulate, as mediated by the presence of the liquid, if not otherwise removed by the air streams.

While the present invention has been illustrated by a description of various preferred embodiments and while these embodiments have been described in some detail, it is not the intention of the applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims.

What is claimed is:

1. A nozzle for dispensing a liquid filament onto a moving strand, comprising:

a nozzle body having a liquid supply port, an air supply port, and a liquid discharge outlet coupled in fluid communication with said liquid supply port; and an air outlet formed in said nozzle body, said air outlet coupled in fluid communication with said air supply port, and said air outlet oriented to discharge air impinging the strand without influencing movement of the liquid filament as the filament is dispensed from said liquid discharge outlet onto the strand, the air contacting the moving strand prior to the filament contacting the strand to remove particulates from the strand at a location upstream relative to said liquid discharge outlet.

2. The nozzle of claim 1, wherein said nozzle body includes a downstream surface relative to the movement of the strand and an upstream surface opposite to said downstream surface, said liquid discharge outlet being located on said downstream surface and said air outlet being located on said upstream surface.

3. The nozzle of claim 1, further comprising a strand guide including a notch, said notch positioned proximate to said liquid discharge outlet and configured to receive and guide the movement of the strand.

4. The nozzle of claim 1 wherein said nozzle body includes an upstream surface relative to the movement of the strand, said air outlet being formed in said upstream surface.

5. The nozzle of claim 3, wherein said air discharged from said air outlet is oriented to maintain a non-contacting relationship between said strand guide and the strand.

6. An applicator for dispensing a liquid filament onto a moving strand, comprising:

a module having a liquid supply passage and an air supply passage;

a nozzle having a liquid discharge outlet coupled in fluid communication with said liquid supply passage;

a strand guide including a notch, said notch positioned proximate to said liquid discharge outlet and configured to receive and guide the movement of the strand; and an air outlet coupled in fluid communication with said air supply passage, said air outlet oriented to discharge air impinging the strand without influencing movement of the liquid filament as the filament is dispensed from said liquid discharge passage onto the strand, the air contacting the moving strand prior to the filament contacting the strand to remove particulates from the strand at a location upstream relative to said liquid discharge outlet, and the air discharged from said air outlet oriented to maintain a non-contacting relationship between said strand guide and the strand.

7. An applicator for dispensing a liquid filament onto a moving strand, comprising:

a module having a liquid supply passage and an air supply passage;

a nozzle having a liquid discharge outlet coupled in fluid communication with said liquid supply passage, said nozzle including a downstream surface relative to the movement of the strand and an upstream surface opposite to said downstream surface, and said liquid discharge outlet is located on said downstream surface; and an air outlet coupled in fluid communication with said air supply passage, said air outlet oriented to discharge air impinging the strand without influencing movement of the liquid filament as the filament is dispensed from said liquid discharge passage onto the strand, the air contacting the moving strand prior to the filament contacting the strand to remove particulates from the strand at a location upstream relative to said liquid discharge outlet, and said air outlet being formed in said upstream surface.

8. An applicator for dispensing a liquid filament onto a moving strand, comprising:

a module having a liquid supply passage and an air supply passage;

a nozzle having a liquid discharge outlet coupled in fluid communication with said liquid supply passage, said nozzle including an upstream surface relative to the movement of the strand; and an air outlet coupled in fluid communication with said air supply passage, said air outlet oriented to discharge air impinging the strand without influencing movement of the liquid filament as the filament is dispensed from said liquid discharge passage onto the strand, the air contacting the moving strand prior to the filament contacting the strand to remove particulates from the strand at a location upstream relative to said liquid discharge outlet, and said air outlet being formed in said upstream surface.

* * * * *